United States Patent [19]

Reece

[11] Patent Number: 4,539,765

[45] Date of Patent: Sep. 10, 1985

[54] TRENCH BACKFILL DEVICE

[75] Inventor: Alan R. Reece, Wylam, England

[73] Assignee: The British Petroleum Company p.l.c., London, England

[21] Appl. No.: 570,515

[22] Filed: Jan. 13, 1984

[30] Foreign Application Priority Data

Jan. 20, 1983 [GB] United Kingdom ..... 8301515

[51] Int. Cl.[3] ..... E02F 5/22

[52] U.S. Cl. ..... 37/142.5; 172/393; 405/179

[58] Field of Search ..... 37/142.5; 405/179, 161, 405/164; 172/387, 393

[56] References Cited

U.S. PATENT DOCUMENTS

| | | | |
|---|---|---|---|
| 1,045,080 | 11/1912 | Purnell | 172/387 |
| 2,795,111 | 6/1957 | Richardson | 405/161 |
| 3,203,188 | 8/1965 | Evans | 37/142.5 X |
| 3,347,054 | 10/1967 | Sherrod . | |
| 3,471,953 | 10/1969 | Wyatt | 37/142.5 |
| 3,540,226 | 11/1970 | Sherrod | 405/164 |
| 3,583,168 | 6/1971 | Horton | 37/142.5 X |
| 3,824,798 | 7/1974 | Shiroyama et al. | 405/164 |
| 4,114,391 | 9/1978 | Kahley, Sr. | 405/176 |
| 4,410,297 | 10/1983 | Lynch | 405/164 |

FOREIGN PATENT DOCUMENTS

| | | | |
|---|---|---|---|
| 523044 | 4/1931 | Fed. Rep. of Germany | 405/179 |
| 1198409 | 7/1970 | United Kingdom . | |
| 398724 | 2/1974 | U.S.S.R. | 37/142.5 |

*Primary Examiner*—Clifford D. Crowder

*Attorney, Agent, or Firm*—Morgan, Finnegan, Pine, Foley & Lee

[57] ABSTRACT

A device for backfilling a trench from spoil left alongside it comprises a forecarriage (7) and a main frame (10). The former comprises means (12) for positioning it centrally in the trench (3). The latter is located behind the former and carries one or more angled blades (9) and lateral stabilizers (18,19) adapted to contact the ground outside the spoil.

The device is towed rather than pushed and if a long tow-rope is used a pipeline can be trenched and the trench backfilled in a single traverse.

3 Claims, 4 Drawing Figures

TRENCH BACKFILL DEVICE

Figure 1:
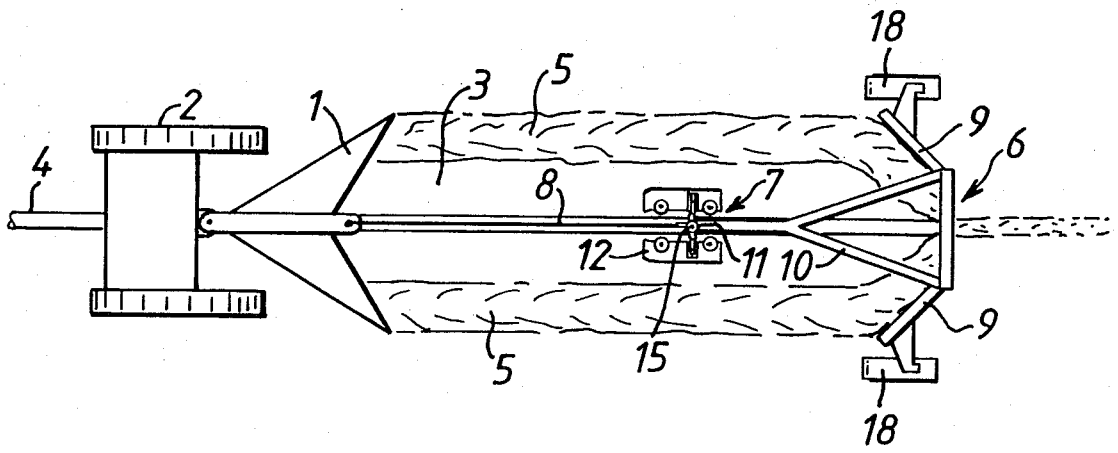

This invention relates to a device for backfilling a trench from spoil left from a trenching operation.

Trenching, particularly for burying underwater pipelines in the sea bed, can be carried out by a trenching plough. This usually operates by cutting a V shaped trench and depositing parallel heaps of spoil on either side of the trench. Alternatively, a steeper sided U-shaped trench can be cut and all the spoil placed to one side of the trench. The pipe is then laid in the trench and in order to bury it the spoil must be pushed back into the trench by an operation known as backfilling.

A backfill device has previously been described in which two angled blades are rigidly mounted in front of a tractor and pushed along by it. Backfilling is performed as a separate operation after the trench has been cut and the pipe laid. This mode of operation is difficult to control underwater because the soil disturbed by the blades makes surveillance difficult.

It is an object of the present invention to provide a device which does not suffer from the above mentioned disadvantage.

According to the present invention there is provided a device for backfilling a trench from spoil, the device comprising a forecarriage comprising means for positioning it centrally in the trench, and a main frame located behind the forecarriage carrying one or more angled blades and lateral stabilisers adapted to contact the ground outside the spoil.

The main frame may be free to pivot about the forecarriage.

Usually the trench will be cut in such a way that two parallel spoil heaps will be formed on either side of the trench. In order to deal with such a situation the device should comprise two angled blades approximately symmetrically mounted.

The means for positioning the forecarriage centrally in the trench may be pivotally mounted skids.

The forecarriage may comprise one or more pairs of rollers adapted to engage with a pipeline laid in the trench and thereby guide the device.

If the device is intended to run on hard ground, the lateral stabilisers may be in the form of wheels. If the device is intended to run on soft ground, the stabilisers may be in the form of skids, preferably with soil engaging fins.

Skids should be connected to their supports so that they can pivot in a plane perpendicular to the soil surface on which they slide.

When the device is intended for use in a V-shaped trench, the wheels or skids should be angled to run on the sloping trench sides.

In use the device may be towed along the pipeline by a tractor or by a long cable from a ship or a plough.

When towing from a plough it is possible to carry out both trenching and backfilling simultaneously in a single traverse providing that the towing cable is sufficiently long to enable the pipe to settle down to the bottom of the trench before spoil is returned to the trench.

Alternatively, the front of the backfill device may be carried directly on a tractor. In this embodiment the tractor is, in effect, the forward support. The tractor runs on the spoil heaps and is steered relative to the pipe in the trench by video, sonar or other sensing system mounted at the front of the tractor, clear of the soil disturbed by the blades. It is convenient to attach the device to the tractor in such a way that it can be lifted clear of the ground for transport by the tractor. In this case it is necessary to provide some freedom for the backfill device to roll relative to the tractor when it is working, but the freedom to roll should be removed when it is lifted.

Figure 2:
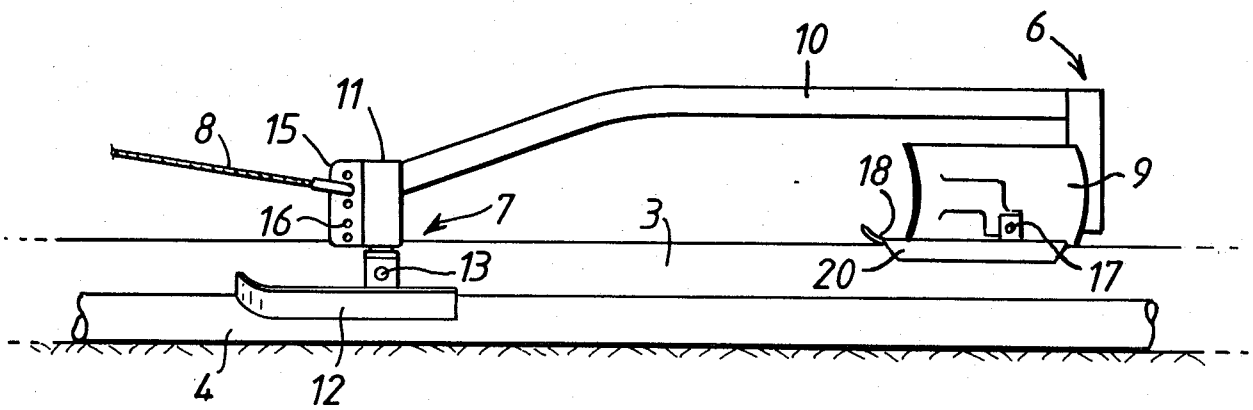
Figure 3:
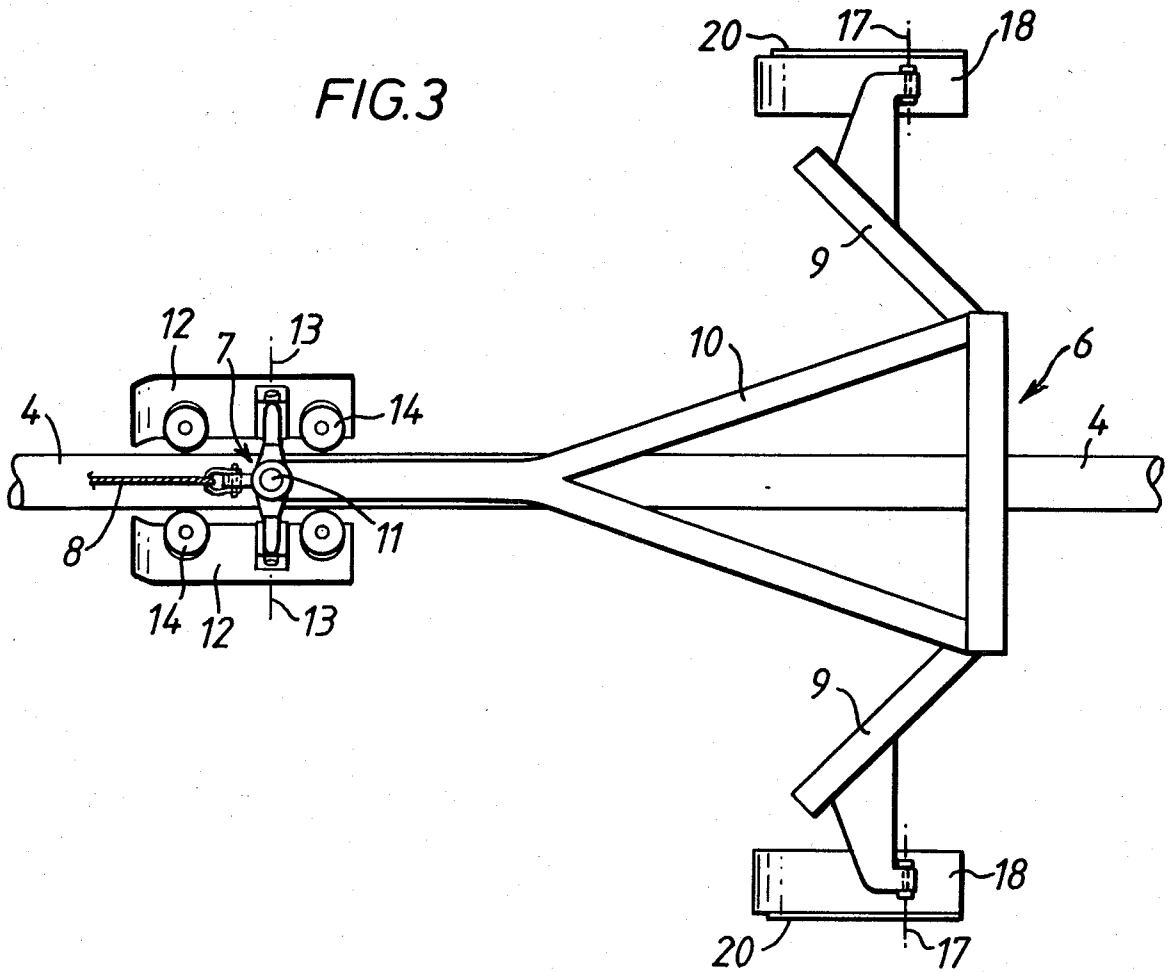
Figure 4:
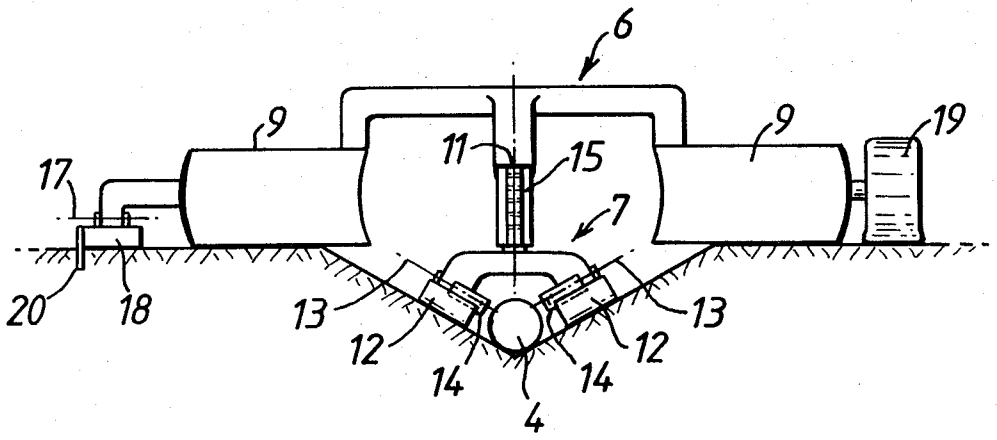

The invention is illustrated by FIGS. 1–4 of the accompanying drawings wherein FIG. 1 is a plan view showing a typical simultaneous trenching and backfilling operation and FIGS. 2, 3 and 4 are more detailed side, plan and front views of the backfill device itself.

With reference to the drawings, a plough 1 towed by a submarine tractor 2 is cutting a trench 3 beneath a pipe 4 which sinks down into the trench. Spoil heaps 5 are deposited on either side of the trench. The backfill device 6 is mounted on a forecarriage 7 and towed by a long cable 8 from the rear of the plough so that it backfills the trench after the pipe has reached the bottom.

The device 6 has two angled blades 9 connected together by a frame 10 which leads forward to a pivot 11 which connects to the forecarriage 7. The forecarriage carries two skids 12 angled to fit the sloping walls of the trench 3 about axes 13, each skid carrying two rollers 14 which guide the skids and their forecarriage along the pipe 4. Fixed to the main frame is a drawbar 15 with a row of hitch points 16 adapted to receive the end of the towing cable. The hitch can be adjusted vertically by the row of hitch points 16.

The rear of the implement is supported on a pair of skids 18 which pivot about axes 17, or, alternatively, if it is known that the sea bed is firm then wheels 19 may be used instead. These wheels or skids are sufficiently far apart to ensure that they run on the sea bed outside the farthest extent of the spoil heaps made by the trenching plough, and they positively control the height of the cutting edge of the blades relative to the sea bed.

When supported on a pair of flat skids at the rear, the device may be unstable in yaw. If it swings to one side the force on the blade on that side decrease and its line of action moves closer to the front pivot 11 while the force on the other blade increases and increases its moment about the pivot. The resulting movement is in the direction of rotating the implement even further in the same direction.

It is therefore desirable to provide stabilising elements as far from the pivot as possible. On firm ground two or more wheels as at 19 rather than skids as at 18 are sufficient, since such wheels develop large side forces if they are obliged to travel at an angle to the plane of the wheels. On soft ground skids will be necessary and they can be given the required side force characteristics by providing fins projecting vertically downwards along one edge as at 20. These fins are preferably on the outer edges of the skids so that they are as far away from the trench as possible.

In the case of a single sided trench with the spoil heap on one side, only one of these fins can take the form of a landside acting on the trench side remote from the side where the spoil was placed.

I claim:

1. A device for back-filling a trench with spoil, the device comprising a forecarriage having pivotally mounted skids adapted to fit into the trench in contact with the walls thereof to locate the forecarriage centrally in the trench and a main frame located behind the forecarriage and connected thereto by a pivot means, the forecarriage comprising one or more pairs of rollers mounted on said skids and adapted to engage with a pipeline laid in the trench and thereby guide the device, the main frame carrying one or more angled blades and lateral stabilisers adapted to contact the ground outside the soil, the said stabilisers being adapted to provide a force which in the event that the said main frame tries to move to an angle to the line of the trench, will tend to restore the main frame so that it travels in the direction of the line of the trench.

2. A device according to claim 1 wherein each lateral stabilizer is a skid fitted with a downwardly projecting fin.

3. A device according to claim 1 wherein the main frame carries two symmetrically mounted angled blades and lateral stabilisers.

* * * * *